United States Patent [19]

Kobayashi et al.

[11] Patent Number: 4,469,072

[45] Date of Patent: Sep. 4, 1984

[54] METHOD AND APPARATUS FOR CONTROLLING THE FUEL-FEEDING RATE OF AN INTERNAL COMBUSTION ENGINE

[75] Inventors: Nobuyuki Kobayashi, Toyota; Hiroshi Itoh, Nagoya, both of Japan

[73] Assignee: Toyota Jidosha Kabushiki Kaisha, Toyota, Japan

[21] Appl. No.: 407,558

[22] Filed: Aug. 12, 1982

[30] Foreign Application Priority Data

Aug. 13, 1981 [JP] Japan ..... 56-125985

[51] Int. Cl.[3] ..... F02D 5/02

[52] U.S. Cl. ..... 123/491; 123/179 L

[58] Field of Search ..... 123/179 L, 491

[56] References Cited

U.S. PATENT DOCUMENTS

| | | | |
|---|---|---|---|
| 3,964,443 | 6/1976 | Hartford | 123/416 |
| 4,250,849 | 2/1981 | Takase | 123/179 L X |
| 4,436,073 | 3/1984 | Miyagi | 123/491 |

*Primary Examiner*—Tony M. Argenbright

*Attorney, Agent, or Firm*—Cushman, Darby & Cushman

[57] ABSTRACT

Engine-starting enrichment is decreased gradually, after the engine is completely started, in response to the temperature difference between the present-coolant temperature and the initial-coolant temperature. The initial-coolant temperature is determined to be equal to the present-coolant temperature just when the engine is completely started.

8 Claims, 8 Drawing Figures

| Fig. 4A | Fig. 4B |
|---|---|

96
IS Fsta = 1 ?
YES
NO
102
IS Fth = 1 ?
YES
NO
97
WL ← WLS
103
WL ← WLSO-(THW-THWO)·B
104
IS WL≦WLS ?
YES
NO
105
WL ← WLS
106
IS WL≧WLN ?
YES
NO
107
WL ← WLN
108
STORE WL IN RAM

METHOD AND APPARATUS FOR CONTROLLING THE FUEL-FEEDING RATE OF AN INTERNAL COMBUSTION ENGINE

BACKGROUND OF THE INVENTION

The present invention relates to a method and apparatus for controlling the fuel-feeding rate of an internal combustion engine during starting of and for a period of time after starting of the engine.

In an internal combustion engine of the electronic fuel-injection control type having fuel injection valves or of the electronic carburetor-control type having an electronically controlled carburetor, not only is a normal warm-up enrichment operation for increasing the fuel-feeding rate depending upon the warm-up condition (coolant temperature) of the engine executed but an engine-starting enrichment operation for additionally increasing the fuel-feeding rate during starting (cranking) of the engine is also executed. When the coolant temperature exceeds a predetermined temperature, the above-mentioned additional increment according to the starting-enrichment operation is gradually decreased to the normal increment in accordance with the lapse of time. Thereafter, the normal warm-up enrichment is executed. These enrichment operations (hereinafter referred to as two-characteristic enrichment) are already known by, for example, SAE paper No. 740,020, pages 237 to 244.

During starting of the engine and for a period of time after starting of the engine, since the temperature of the inner wall in the combustion chamber is low, the engine requires a rich air-fuel mixture in order for good operating characteristics to be obtained. Therefore, during starting of and for a while after starting of the engine, the above starting-enrichment operation is carried out. However, since the inner wall temperature rises faster than the coolant temperature, which is, in general, used for detecting the warm-up condition of the engine, the starting-enrichment operation need not be executed until the engine is fully warmed-up. Accordingly, when the coolant temperature rises higher than a predetermined temperature during starting and after starting of the engine, the starting increment of the fuel-feeding rate is gradually decreased to the normal increment, according to the normal warm-up enrichment operation, with the lapse of time, causing the emission control characteristics to improve.

However, according to the above-mentioned conventional two-characteristic enrichment, since transfer from the starting enrichment to the normal warm-up enrichment starts depending upon the coolant temperature, if the detected coolant temperature is not accurately representative of the actual warm-up condition of the engine, problems occur. In general, the coolant-temperature sensor is located in the area of the engine block near the outlet of the coolant passage. The coolant temperature near the coolant passage outlet is not representative of the warm-up condition but is representative of the environment temperature at a time just after the engine is started. Therefore, if the environment temperature is higher than a predetermined temperature, the starting increment decreases irrespective of the low-inner wall temperature of the combustion chamber. Thus, appropriate fuel increment corresponding to the inner wall temperature of the combustion chamber cannot be expected according to the prior control technique.

SUMMARY OF THE INVENTION

It is, therefore, an object of the present invention to provide a method and apparatus for controlling the fuel-feeding rate of an internal combustion engine, whereby the most suitable starting enrichment can be executed, causing the emission control characteristics, namely the pollution reduction performance, to extremely improve.

According to the present invention, after complete starting of the engine, the fuel-feeding rate is corrected in accordance with an additional increment which is decreased from the value of the starting-enrichment amount just at the time starting of the engine is completed to the normal warm-up enrichment amount by an indication of decrease which depends upon the temperature difference between the coolant temperature at the time starting of the engine is completed and the present coolant temperature.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
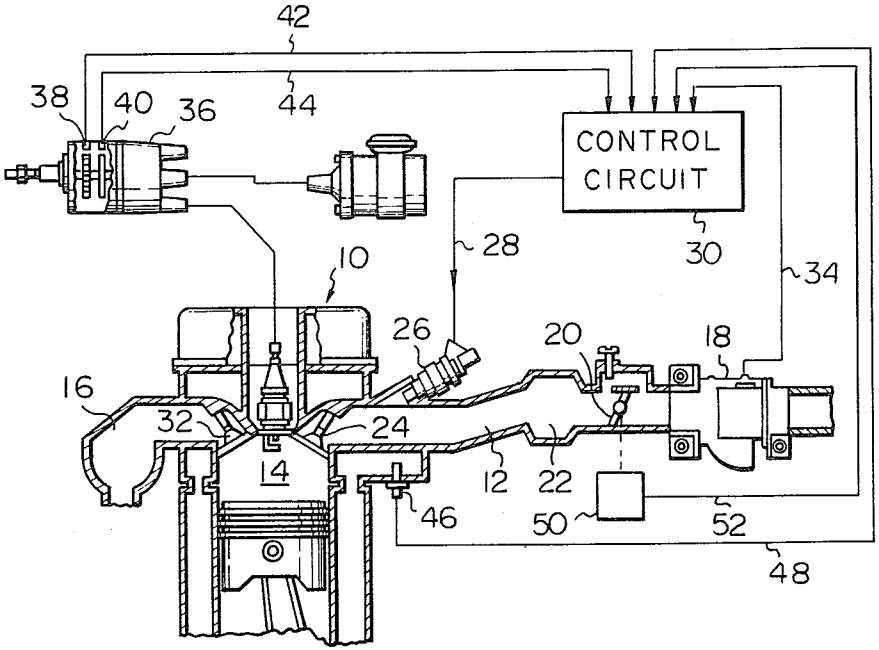
FIG. 1 is a schematic diagram of an electronic fuel-injection control system of an internal-combustion engine as an embodiment of the present invention.

In FIG. 1, reference numeral 10 denotes an engine body, 12 an intake passage, 14 a combustion chamber, and 16 an exhaust passage. The flow rate of intake air introduced through an air cleaner, which is not shown, is measured by an air-flow sensor 18. The intake-air flow rate is controlled by a throttle valve 20 interlocked with an accelerator pedal which is not shown. The intake air passing through the throttle valve 20 is introduced into the combustion chamber 14 via a surge tank 22 and an intake valve 24.

Each of fuel-injection valves 26 for the respective cylinders is opened and closed in response to electrical drive pulses that are fed from a control circuit 30 via a line 28. The fuel-injection valves 26 intermittently inject into the intake passage 12 in the vicinity of the intake valve 24 compressed fuel which is supplied from a fuel supply system which is not shown.

The exhaust gas which is produced due to combustion in the combustion chamber 14 is emitted via an exhaust valve 32, the exhaust passage 16, and a catalytic converter which is not shown.

The air-flow sensor 18 is disposed in the intake passage 12 at a position upstream of the throttle valve 20 to detect the intake-air flow rate. The detection signal from the air-flow sensor 18 is fed to the control circuit 30 via a line 34.

Crank-angle sensors 38 and 40 disposed in a distributor 36 produce pulse signals at every crank angle of 30° and 720°, respectively. The pulse signals produced at every crank angle of 30° are fed to the control circuit 30 via a line 42, and the pulse signals produced at every crank angle of 720° are fed to the control circuit 30 via a line 44.

A coolant-temperature sensor 46 detects the temperature of the coolant in the engine. The output signal from the coolant temperature sensor 46 is fed to the control circuit 30 via a line 48.

A throttle position switch 50 interlocked with the throttle valve 20 produces a signal which indicates whether or not the throttle valve 20 is in the fully closed position. The signal of the throttle position switch 50 is fed to the control circuit 30 via a line 52.

Figure 2:
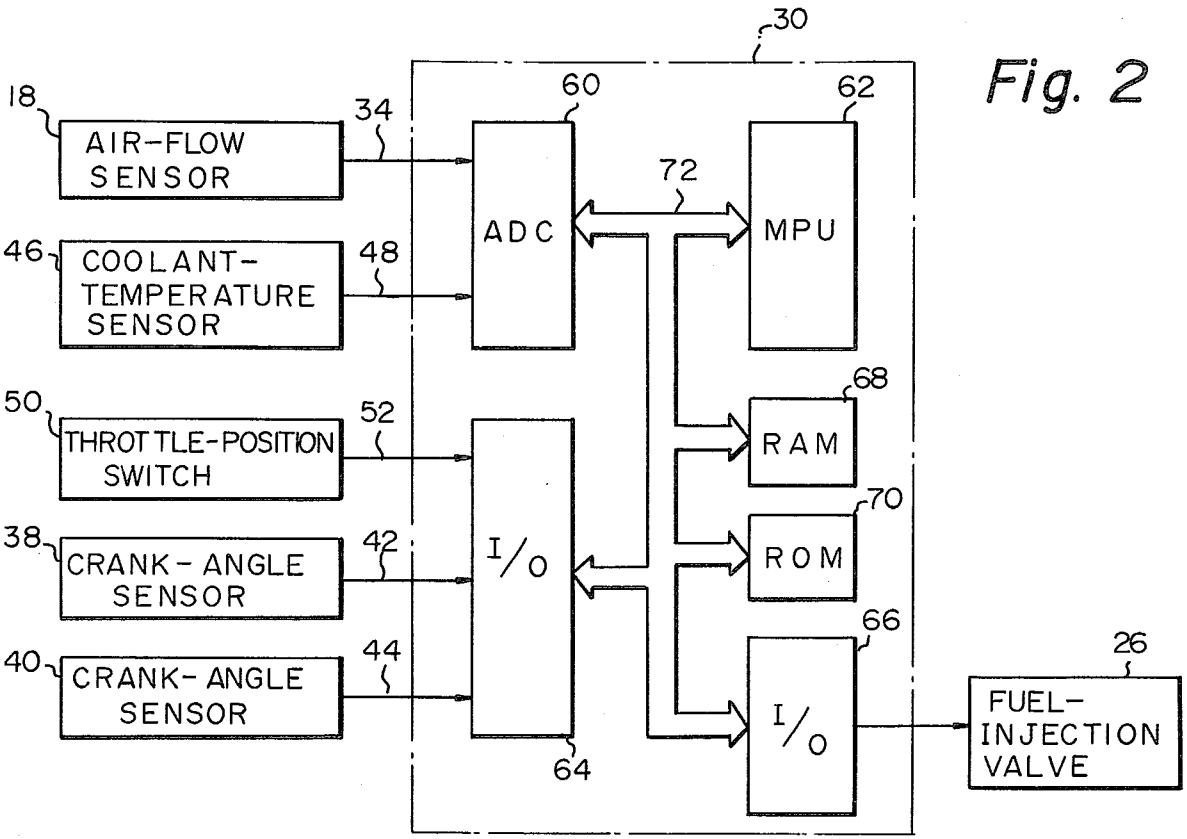
FIG. 2 is a block diagram of the control circuit shown in FIG. 1.

FIG. 2 illustrates an example of the control circuit 30 of FIG. 1. In FIG. 2, the air-flow sensor 18, coolant-temperature sensor 46, crank-angle sensors 38 and 40, throttle-position switch 50, and fuel-injection valve 26 are represented by blocks, respectively.

Signals from the air-flow sensor 18 and the coolant-temperature sensor 46 are fed to an analog-to-digital (A/D) converter 60, which contains an analog multiplexer, and are sequentially converted into signals in the form of binary numbers in response to instructions from a microprocessor (MPU) 62.

The pulse signals produced by the crank-angle sensor 38 at every crank angle of 30° are fed to the MPU 62 via an input-output (I/O) circuit 64 as interrupt-request signals for the interruption routine of every 30° crank angle. The pulse signals from the crank angle-sensor 38 are further supplied to a timing counter disposed in the I/O circuit 64 as counting pulses. The pulse signals produced by the crank-angle sensor 40 at every crank angle of 720° are used as reset pulses of the above timing counter.

A signal having a level of "1" or "0", which indicates whether the throttle valve 20 is fully closed, from the throttle-position switch 50 is fed to the I/O circuit 64 and is temporarily stored therein.

In an I/O circuit 66, a register which receives output data corresponding to a fuel-injection pulse width of $\tau$ from the MPU 62, a binary counter which starts the counting operation with respect to clock pulses when fuel-injection initiation pulses are applied from the I/O circuit 64, a binary comparator for comparing the contents in the above register and binary counter, and a driver are provided. The binary comparator produces an injection pulse signal of "1" level from the time when the fuel-injection initiation pulse is applied until the contents of the binary counter coincide with the contents of the register. Therefore, the injection pulse signal produced by the binary comparator has a pulse width of $\tau$. The injection pulse signal is fed to the fuel-injection valve 26 via the driver. The fuel-injection valve 26 thus injects into the engine a quantity of fuel corresponding to the pulse width $\tau$ of the injection pulse signal.

The A/D converter 60 and I/O circuits 64 and 66 are connected via a bus 72 to the MPU 62, a random access memory (RAM) 68, and a read only memory (ROM) 70 which constitute the microcomputer. The data are transferred via the bus 72.

Figure 6:
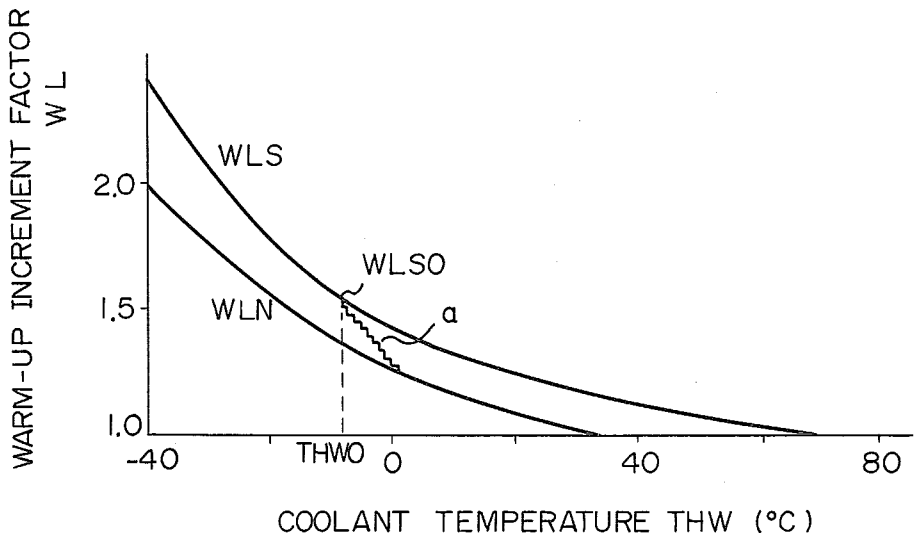
FIG. 6 is a graph of enrichment factors WLS and WLN versus coolant temperature THW.

In the ROM 70 are stored beforehand a routine program for main processing, an interrupt-processing program for the arithmetic calculation of the fuel-injection pulse width, another routine program, and various types of data which is necessary for carrying out arithmetic calculation, for example, map data (or algebraic functions) of warm-up increment factor WL with respect to coolant temperature THW shown in FIG. 6.

Hereinafter, the operation of the microcomputer will be illustrated with reference to the flow diagrams of FIGS. 3 to 5.

Figure 3:
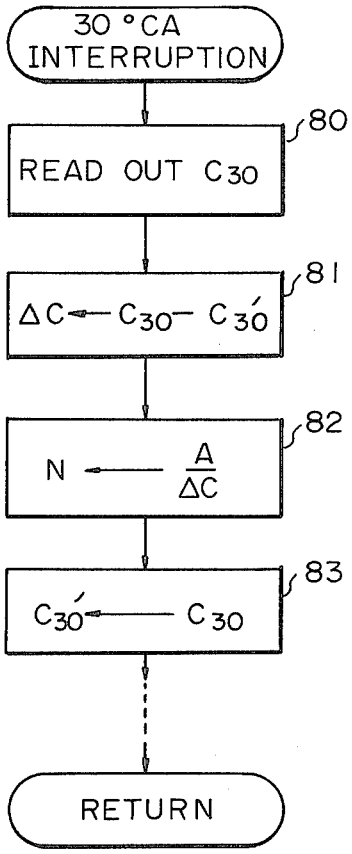
FIGS. 3, 4, 4A, 4B and 5 are flow diagrams of control programs according to an embodiment of the present invention.

When a pulse signal at every crank angle of 30° is applied from the crank angle sensor 38, the MPU 62 executes the interrupt-processing routine shown in FIG. 3 for producing rpm data which indicates actual rotational speed N of the engine.

At point 80, the contents of the free-run counter provided in the MPU 62 are read out and temporarily stored in the register in the MPU 62 as $C_{30}$. At point 81, the difference $\Delta C$ between contents $C_{30}$ of the free-run counter which are read out in the present interruption process and contents $C_{30}'$ of the free-run counter, which contents were read out in the last interruption process is calculated from $\Delta C = C_{30} - C_{30}'$. Then, at point 82, the reciprocal of the difference $\Delta C$ is calculated to obtain rotational speed N. Namely, at the point 82, calculation of $N = A/\Delta C$ is executed, where A is a constant. Calculated N is stored in the RAM 68. At point 83, contents $C_{30}$ in the present interruption process are stored in the RAM 68 as contents $C_{30}'$ of the free-run counter in the last interruption process and are used in the next interruption process. Thereafter, another process is executed in the interrupt-processing routine and then the program returns to the main processing routine.

MPU 62 further introduces a binary signal which indicates intake-air flow rate Q and a binary signal which indicates coolant temperature THW from the A/D converter 60 in response to the interrupt request which occurs at every completion of A/D conversion. Then the MPU 62 stores the introduced binary signals in the RAM 68.

Furthermore, the MPU 62 checks a predetermined bit of the I/O circuit 64 at a certain constant interval so as to discriminate whether the signal from the throttle-position switch 50 is "1" or "0". Then the discriminated result is stored in the RAM 68 as a flag Fth.

Figures 4, 4A:
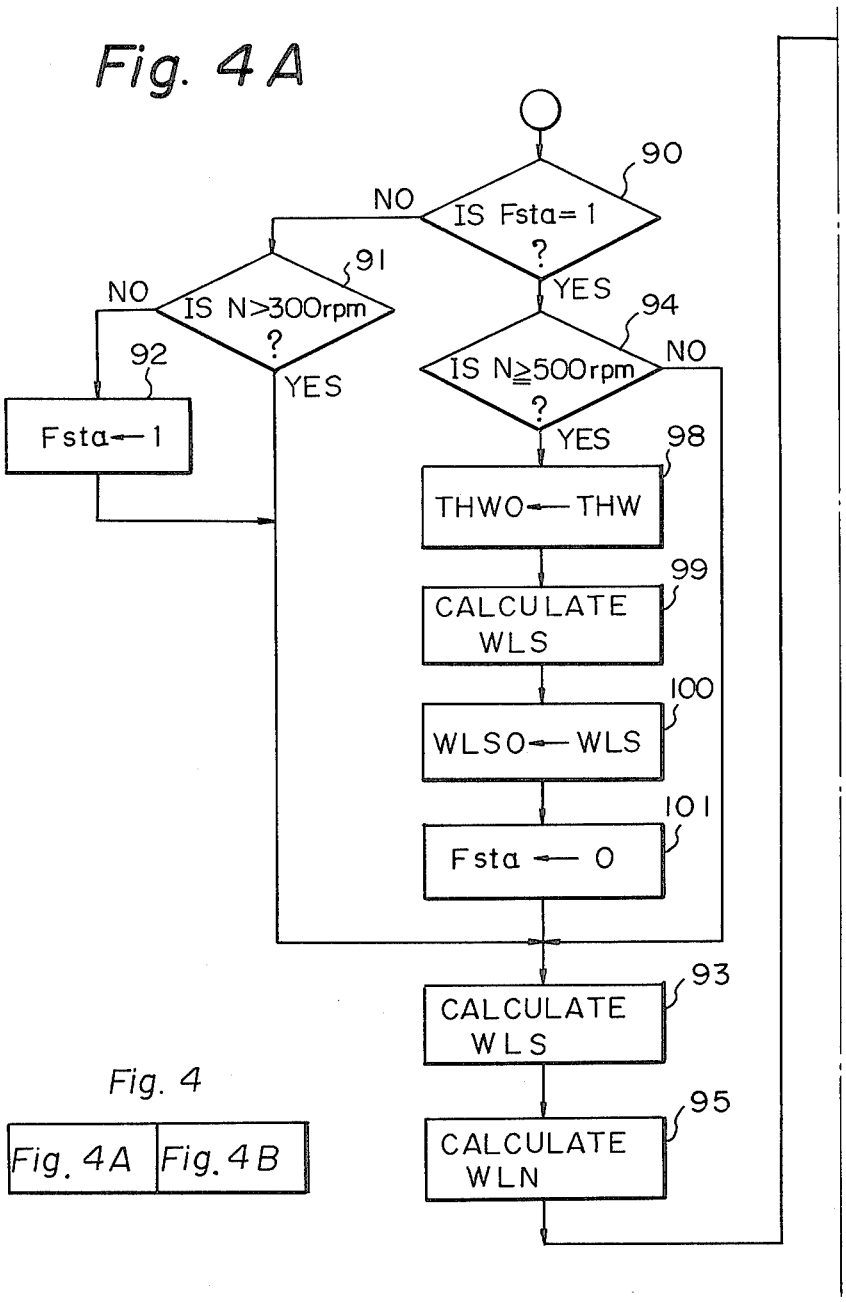
Figure 4B:
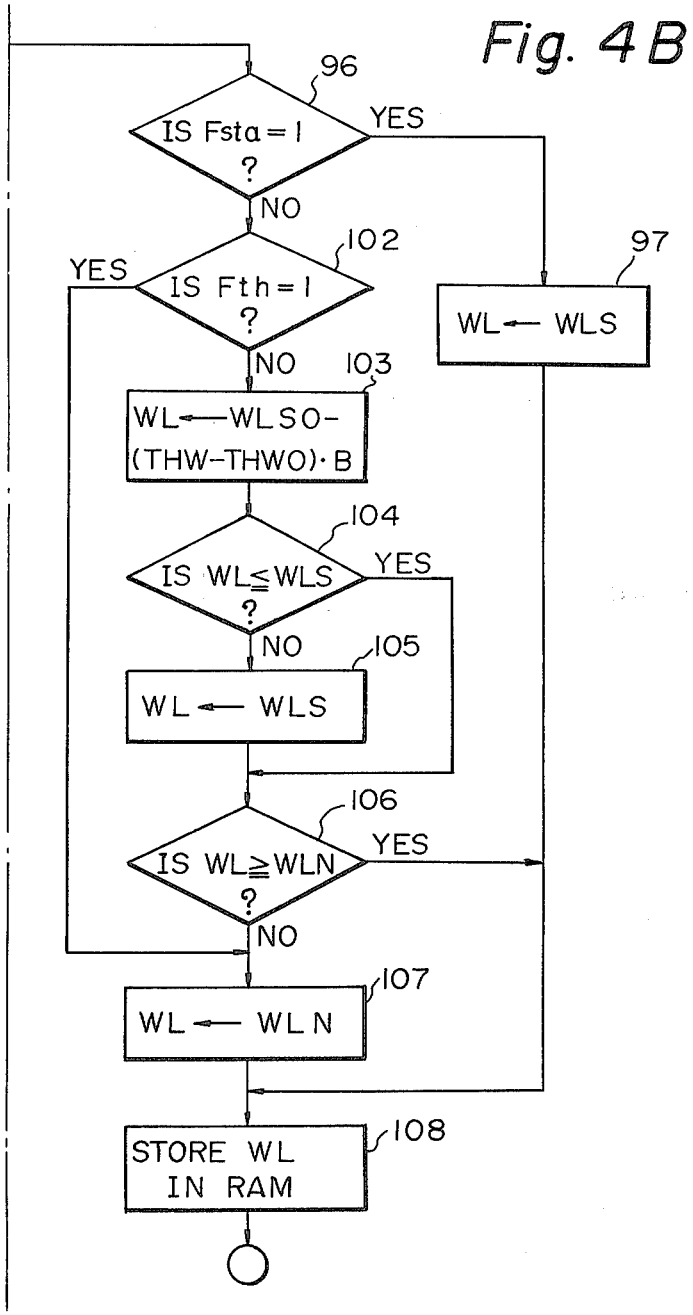

During the main processing routine, the MPU 62 executes the process shown in FIG. 4. At point 90, whether a starter flag Fsta is "1" or "0" is discriminated. The starter flag Fsta indicates whether the engine is starting or has been started. The flag Fsta is formed by the software in accordance with rotational speed N of the engine. When the ignition key switch is turned on and the RAM 68 is initialized, the starter flag Fsta is reset to "0".

During starting of the engine or at the first operation cycle after the ignition key switch is turned on, since the starter flag Fsta is "0" (Fsta=0), the program proceeds from point 90 to point 91. At point 91, it is discriminated whether or not rotational speed N is higher than 300 rpm according to the detection data stored in the RAM 68. As $N \leqq 300$ rpm at the first operation cycle after the ignition key switch is turned on, the starter flag Fsta is set to "1" at point 92. During a normal operating condition of the engine, as $N > 300$ rpm, the program proceeds from point 91 to point 93.

At point 90, if it is discriminated that Fsta=1, the program proceeds to point 94 where it is discriminated whether or not the rotational speed N is $N \geqq 500$ rpm. In other words, at point 94 it is discriminated whether the engine is completely started or not. If $N < 500$ rpm, it is discriminated that the engine is starting, and thus the program proceeds to point 93. At point 93, starting-enrichment factor WLS is found from the THW-WLS map or THW-WLS algebraic functions, in accordance with coolant temperature THW at that time, stored in the RAM 68. In the ROM 70 there is stored beforehand the relationship between starting enrichment WLS and coolant temperature THW, as shown in FIG. 6, in the form of a THW-WLS map or THW-WLS algebraic functions.

At the next point 95, normal warm-up enrichment factor WLN is found from the THW-WLN map or THW-WLN algebraic functions in accordance with coolant temperature THW. In the ROM 70 is also stored beforehand the relationship between normal warm-up enrichment WLN and coolant temperature THW, as shown in FIG. 6, in the form of a THW-WLN map or THW-WLN algebraic functions. At point 96, whether the starter flag Fsta is "1" or not is discriminated. If Fsta=1, the program proceeds to point 97 where warm-up increment factor WL is equalized to starting-enrichment factor WLS. At point 108, warm-up increment factor WL is stored in the RAM 68, whereby the present time operation cycle of the processing routine shown in FIG. 4 is finished. As mentioned above in detail, if the engine is starting, warm-up increment factor WL is equalized to starting-enrichment factor WLS.

At point 94, if N≧500 rpm, it is discriminated that the engine is completely started, and thus the process of point 98 to 101 is executed. At point 98, coolant temperature THW at that time is stored in the RAM 68 as initial-coolant temperature THWO. Then at point 99, starting-enrichment factor WLS corresponding to stored initial coolant temperature THWO is found in the same way at point 93. At point 100, starting-enrichment factor WLS found at point 99 is stored in the RAM 68 as initial-enrichment factor WLSO. According to the process at points 99 and 100, the coolant temperature and the starting-enrichment factor just at the time the engine is completely started are maintained as THWO and WLSO, respectively. At point 101, the starter flag Fsta is reset to "0".

Thereafter, since Fsta=0, the program proceeds from point 96 to point 102. At point 102, whether the flag Fth is "1" or "0", in other words, whether or not the throttle valve 20 is in the fully closed position, is discriminated. If the throttle valve 20 is in the fully closed position, it is not necessary to enrich the air-fuel mixture. Therefore, in this case, the program proceeds to point 107 where warm-up increment factor WL is equalized with normal warm-up enrichment WLS so as to control the air-fuel mixture so that it becomes lean, thereby effecting a reduction in fuel consumption.

If Fth=0 (throttle valve 20 is not fully closed), the program proceeds to point 103 where the warm-up increment factor according to starting-enrichment factor WLS is decreased. The decrease operation at point 103 is carried out by subtracting a value which depends upon the difference between initial-coolant temperature THWO and the coolant temperature at that time from initial-enrichment factor WLSO. Namely, at point 103, calculation according to the equation $$WL = WLSO - (THW - THWO) \cdot B$$

where B is a constant is executed.

The process at points 104 to 107 is to limit warm-up increment factor WL within the range of WLN and WLS (WLN≦WL≦WLS).

If the process at points 103 to 107 is repeatedly executed in the following operation cycles, warm-up increment factor WL is decreased from initial factor WLSO, in response to the difference of (THW−THWO) as shown by a in FIG. 6, and, finally, warm-up increment factor WL is equalized with normal warm-up enrichment factor WLN and this equalization is maintained.

Figure 5:
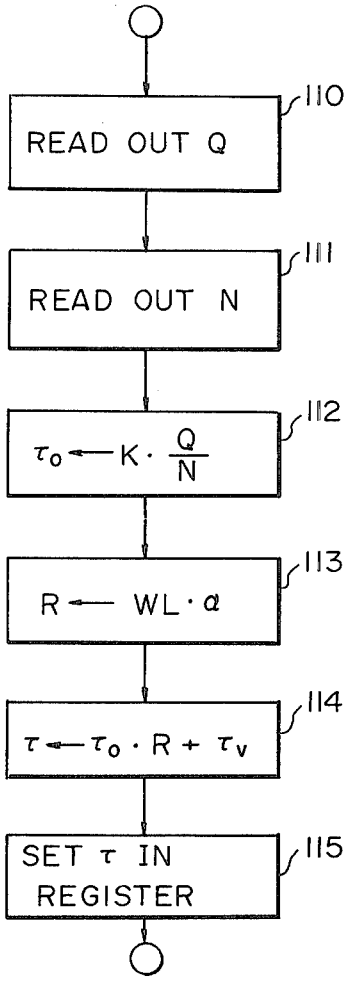

During the main processing routine, the MPU 62 further executes the processing routine shown in FIG. 5. At points 110 and 111, the MPU 62 reads out the data related to intake-air flow rate Q and rotational speed N from the RAM 68, respectively. At point 112, the MPU 62 calculates a basic fuel-injection pulse width of $\tau_0$ of the injection pulse fed to the fuel-injection valve 26, according to the equation $$\tau_0 = K \cdot (Q/N)$$

where K is a constant. Then, at point 113, total-increment correction factor R is calculated from the equation $$R = WL \cdot \alpha$$

where $\alpha$ mis another fuel-increment factor. At point 114, the MPU 62 calculates a pulse width of $\tau$ from the equation $$\tau = \tau_0 \cdot R + \tau_V$$

where $\tau_V$ is a value that corresponds to an ineffective injection pulse width of the fuel-injection valve 26. The data which corresponds to the thus-calculated pulse-width of $\tau$ is set at point 115 to the aforementioned register in the I/O circuit 66.

As illustrated in detail in the foregoing, according to the present invention, the engine-starting enrichment is decreased after the engine is completely started, in response to the temperature difference between the present-coolant temperature and the initial-coolant temperature which is equivalent to the coolant temperature when the engine is completely started. Since the initial-coolant temperature is determined at a time when the engine is completely started and thus the coolant is fully circulated, and furthermore since the enrichment is decreased in response to the temperature difference between the above initial-coolant temperature and the coolant temperature of the present time, warm-up increment factor WL is accurately controlled depending upon the warm-up condition of the engine, whereby the most suitable two-characteristic enrichment can be executed, resulting in a great improvement of the emission control characteristics.

As many widely different embodiments of the present invention may be constructed without departing from the spirit and scope of the present invention, it should be understood that the present invention is not limited to the specific embodiments described in this specification, except as defined in the appended claims.

We claim:

1. A method for controlling the fuel-feeding rate of an internal combustion engine, comprising the steps of:

detecting the coolant temperature of the engine to generate a first electrical signal which indicates the detected coolant temperature;

discriminating whether the engine is completely started or not to generate a second electrical signal which indicates the discriminated result;

calculating, in response to said first electrical signal, a first additional increment of the fuel-feeding rate of the engine, said first additional increment being determined depending upon the detected coolant temperature;

calculating, in response to said first electrical signal, a second additional increment of the fuel-feeding rate of the engine, said second additional increment being determined depending upon the detected coolant temperature;

calculating, in response to said first and second electrical signals, the difference between the coolant temperature just at the time the engine is completely started and the present coolant temperature;

correcting the fuel-feeding rate of the engine in accordance with said calculated second additional increment during starting of the engine; and correcting the fuel-feeding rate of the engine after the engine is completely started, in accordance with a third additional increment which is gradually decreased from the value of said calculated second additional increment just at the time the engine is completely started to said calculated first additional increment, inclination of the decrease of said third additional increment being dependent upon said calculated temperature difference.

2. A method as claimed in claim 1, wherein said correcting step after starting of the engine includes a step of decreasing the third additional increment so that the greater the calculated temperature difference, the greater the inclination of decrease.

3. A method as claimed in claim 1, wherein said method further comprises a step of detecting whether the throttle valve of the engine is in the fully closed position or not to generate a third electrical signal which indicates the detected result, and said correcting step after starting of the engine includes a step of equalizing, in response to said third electrical signal, the third additional increment with said first additional increment when the throttle valve is in the fully closed position.

4. A method as claimed in claim 1, 2, or 3, wherein said discriminating step includes the steps of:

detecting the rotational speed of the engine to generate a fourth electrical signal which indicates the detected rotational speed; and discriminating, in response to the fourth electrical signal, whether the detected rotational speed exceeds a predetermined speed which is lower than the idle speed.

5. An apparatus for controlling the fuel-feeding rate of an internal-combustion engine, comprising:

means for detecting the coolant temperature of the engine to generate a first electrical signal which indicates the detected coolant temperature;

means for discriminating whether the engine is completely started or not to generate a second electrical signal which indicates the discriminated result;

means for calculating, in response to said first electrical signal, a first additional increment of the fuel-feeding rate of the engine, said additional increment being determined depending upon the detected coolant temperature;

means for calculating, in response to said first electrical signal, a second additional increment of the fuel-feeding rate of the engine, said second additional increment being determined depending upon the detected coolant temperature;

means for calculating, in response to said first and second electrical signals, the difference between the coolant temperature just at the time the engine is completely started and the present coolant temperature;

means for correcting the fuel-feeding rate of the engine in accordance with said calculated second additional increment during starting of the engine; and means for correcting the fuel-feeding rate of the engine, after complete starting of the engine, in accordance with a third additional increment which is decreased from the value of said calculated second additional increment just at the time the engine is completely started to said calculated first additional increment, the inclination of decrease of said third additional increment being dependent upon said calculated temperature difference.

6. An apparatus as claimed in claim 5, wherein said correction means after starting of the engine includes means for decreasing the third additional increment so that the greater the calculated temperature difference, the greater the inclination of decrease.

7. An apparatus as claimed in claim 5, wherein said apparatus further comprises a throttle valve and means for detecting whether the throttle valve is in the fully closed position or not to generate a third electrical signal which indicates the detected result, and said correction means after starting of the engine includes means for equalizing, in response to said third electrical signal, said third additional increment with said first additional increment when the throttle valve is in the fully closed position.

8. An apparatus as claimed in claim 5, 6, or 7, wherein said discriminating means includes:

means for detecting the rotational speed of the engine to generate a fourth electrical signal which indicates the detected rotational speed; and means for discriminating, in response to the fourth electrical signal, whether the detected rotational speed exceeds a predetermined speed which is lower than the idle speed.

* * * * *